US005417538A

United States Patent [19]

Wilde

[11] Patent Number: 5,417,538

[45] Date of Patent: May 23, 1995

[54] APPARATUS FOR SCOOPING AN ARTICLE FROM THE GROUND

[76] Inventor: Graham Wilde, 49 Duncan Street, Sandringham 3191, Victoria, Australia

[21] Appl. No.: 193,451

[22] Filed: Feb. 8, 1994

[30] Foreign Application Priority Data

Feb. 8, 1993 [AU] Australia ..... PL7137

[51] Int. Cl.[6] ..... B60P 3/00

[52] U.S. Cl. ..... 414/440; 56/328.1; 414/501; 414/439; 414/434; 414/539

[58] Field of Search ..... 414/434, 435, 436, 437, 414/438, 439, 440, 441, 442, 443, 507, 469, 467, 468, 473, 486, 487, 488, 518, 527, 501, 539; 56/328.1

[56] References Cited

U.S. PATENT DOCUMENTS

| | | | |
|---|---|---|---|
| 1,189,016 | 6/1916 | Thompson | 414/439 X |
| 2,484,437 | 10/1949 | Wells | 414/440 |
| 2,964,204 | 12/1960 | Wilson | 414/439 |
| 3,362,551 | 1/1968 | Shoemaker | 414/440 |
| 3,593,868 | 7/1971 | Folz | 414/440 |
| 3,888,370 | 6/1975 | Gamblin . | |
| 3,989,151 | 11/1976 | Dyer . | |
| 3,995,759 | 12/1976 | Hollrock et al. | 414/440 |
| 4,221,524 | 9/1980 | Morris | 414/439 |
| 4,721,428 | 1/1988 | Rohrer . | |
| 4,735,544 | 4/1988 | Stotts . | |
| 5,213,464 | 5/1993 | Nicholson et al. | 414/439 X |

FOREIGN PATENT DOCUMENTS

| | | | |
|---|---|---|---|
| 84204 | 1/1958 | Denmark | 414/439 |
| 1555265 | 11/1979 | United Kingdom . | |
| 86/03419A1 | 6/1986 | WIPO . | |
| 88/06910A1 | 9/1988 | WIPO . | |

*Primary Examiner*—Frank E. Werner
*Attorney, Agent, or Firm*—Larson and Taylor

[57] ABSTRACT

An apparatus is provided for scooping up articles typically golf balls, from the ground comprising a rotary scoop 16 which can rotate about an axis 18 extending parallel to the ground 14. The scoop 16 is provided with three elongate elements uniformly spaced in the radial direction about and extending parallel to the axis of rotation 18. A curved plate 32 is located behind the scoop 16 in the direction of travel D of the apparatus 10. The plate 32 has a lower edge 34 extending parallel to the ground 14 at a height to prevent the passage of the golf ball to fall between the edge 34 and the ground 14. A cylindrical receptacle 38 is located between the elongate elements 20 and has its longitudinal axis coincident with the axis of rotation 18. An opening 40 is formed along the length of the receptacle 38 near an upper edge 42 of the place 32. A golf ball 12 scooped by the scoop 16 is guided by plate 32 so as to fall by the action of gravity through opening 40 into the receptacle 48. The scoop 16 is driven by ground engaging wheels 58 and 60 of the apparatus 10 as the apparatus is pushed over the ground 12.

12 Claims, 3 Drawing Sheets

APPARATUS FOR SCOOPING AN ARTICLE FROM THE GROUND

The present invention relates to an apparatus for scooping an article from the ground and in particular, but not exclusively, to an apparatus for scooping golf balls from the ground.

It is known to use small ride-on tractors to pick up golf balls from the ground. These tractors are provided with at least one row of ground-engaging rubber discs. The faces of each disc are convexly curved so as to form a substantially triangular radial groove or space between adjacent discs. When the tractor is driven over the ground, golf balls in the path of the row of discs become wedged in the grooves or spaces and carried by the discs. The discs rotate in the direction of rotation of the wheels of the tractor. Accordingly, golf balls lodged between adjacent discs are pressed against the ground. The machine is provided with a comb having a tooth extending into the groove or space between adjacent discs for dislodging the golf ball held therebetween. The dislodged golf balls then fall into a bin.

One disadvantage with this type of tractor for picking up golf balls is that because the balls are pushed against the ground they can create dents in the ground and/or become pressed into and embedded in the ground. A further disadvantage is that even though this type of tractor is relatively small its weight may still cause its wheels to form ruts in the ground, particularly when wet.

It is an object of the present invention to provide an apparatus for scooping articles from the ground, which attempts to substantially alleviate the disadvantages of the above described prior art.

According to the present invention there is provided an apparatus for scooping an article from the ground comprising:

rotary scooping means for scooping an article from the ground and;

guiding means having a lower edge extending substantially parallel to the ground at a height to prevent the passage of an article between said edge and said ground, said guiding means configured so as to guide an article scooped from the groun by siad scooping mesans into a receptacle;

whereby, in use, when said apparatus is moved over an article on the ground, said article is brought into contact with said lower edge, scooped from the ground by said rotary scooping means and guided by said guiding means into said receptacle.

Preferably, said rotary scooping means rotates about an axis extending substantially parallel to the ground.

Preferably, said rotary scooping means comprises an elongate element extending parallel to said axis of rotation and radially spaced from said axis by a distance such that for a portion of a revolution of said rotary scooping means said elongate element can contact an article on the ground and direct said article toward said lower edge.

Preferably, said elongate element is one of a plurality of elongate elements uniformly spaced radially about said axis.

Preferably, said elongate elements rotate about the periphery of said receptacle.

Preferably, said receptacle and said rotary scooping means are supported by a sub-frame which is pivotably connected to a main frame, whereby said sub-frame can be pivoted between a first position in which said apparatus can scoop an article from the ground and a second position in which said receptacle can be emptied by the action of gravity on any article held in said receptacle.

Preferably, said apparatus further comprises a storage bin supported by said main frame, said storage bin located so that when said sub-frame is in said second position, any article held in said receptacle can fall into said storage bin.

Preferably, said apparatus is provided with one or more ground-engaging wheels for allowing said apparatus to be moved over said ground.

Preferably, at least one ground-engaging wheel is rotatably coupled at each side of a mouth of said apparatus, said mouth leading to said rotary scooping means.

Preferably, said apparatus is further provided with a flange at each side of said mouth, each flange extending forward of an adjacent ground-engaging wheel in the direction of travel of said apparatus for guiding articles lying in the path of said wheels into said mouth.

Preferably, said apparatus is further provided with a ground-engaging roller rotatably coupled to the main frame and disposed to the rear of said guiding means in the direction of travel of said apparatus for smoothing the ground.

Preferably, said roller is one of at least two spaced apart rollers.

Preferably, said rotary scooping means is driven by the rotation of said ground-engaging wheels as said apparatus moves over the ground.

An embodiment of the invention will now be described by way of example only with reference to the accompanying drawings in which.

Figure 1:
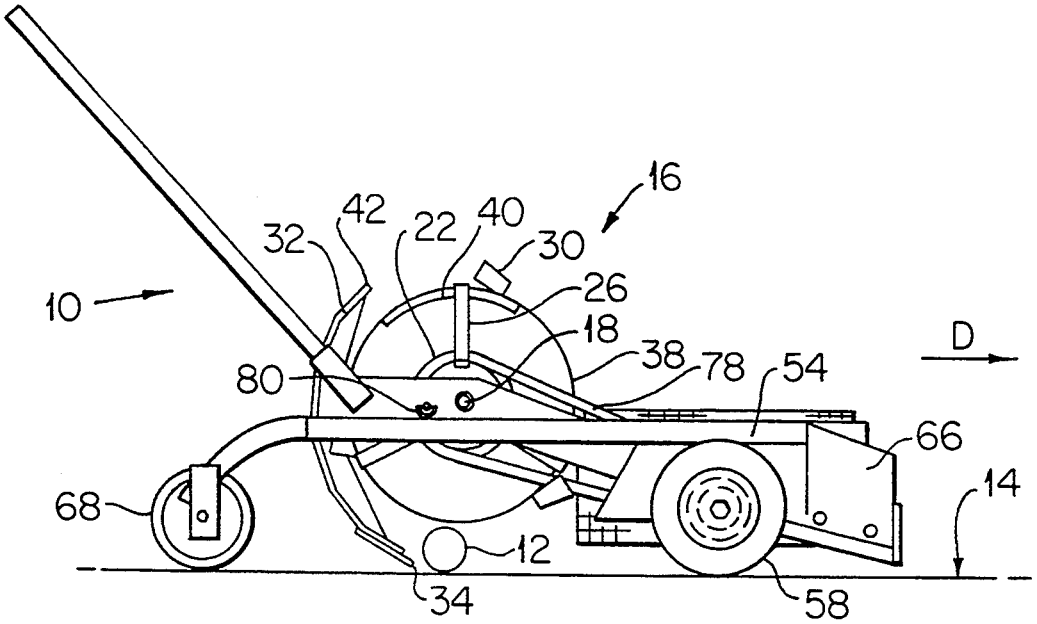
FIG. 1 is a right side view of the apparatus.
Figure 2:
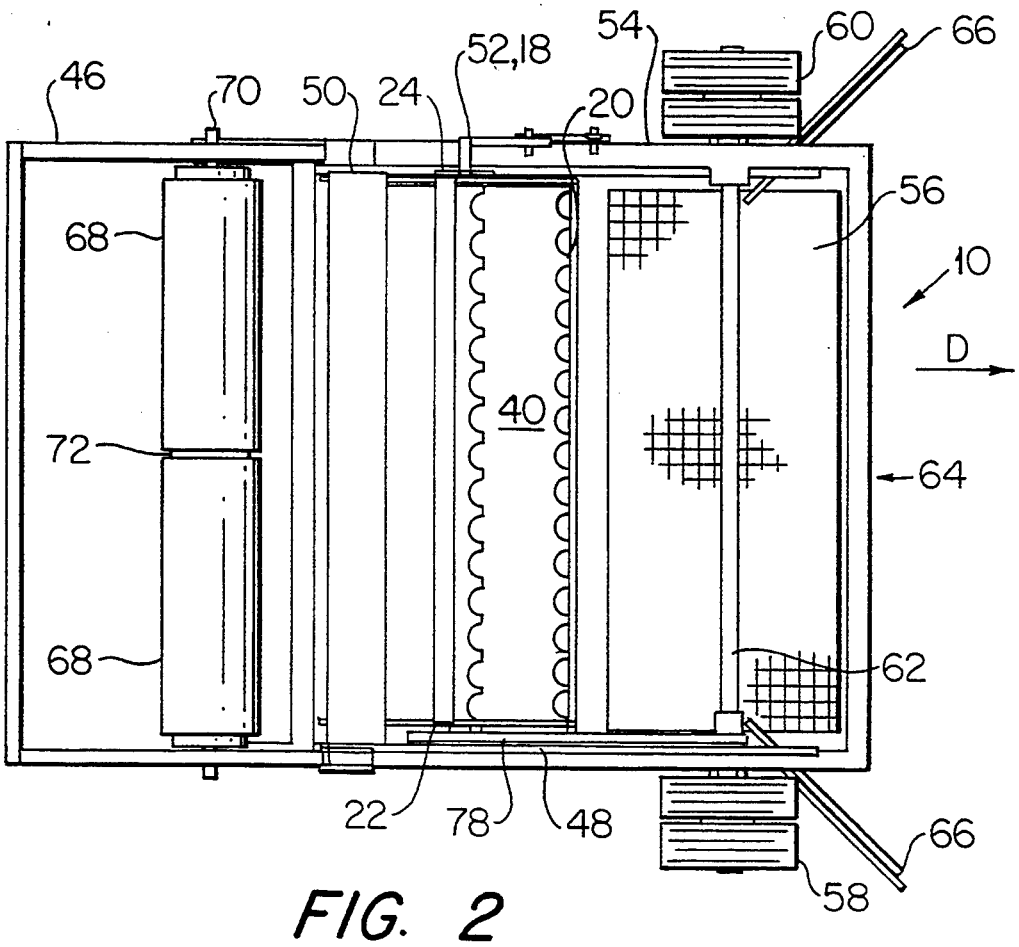
FIG. 2 is a top view of the apparatus.
Figure 3:
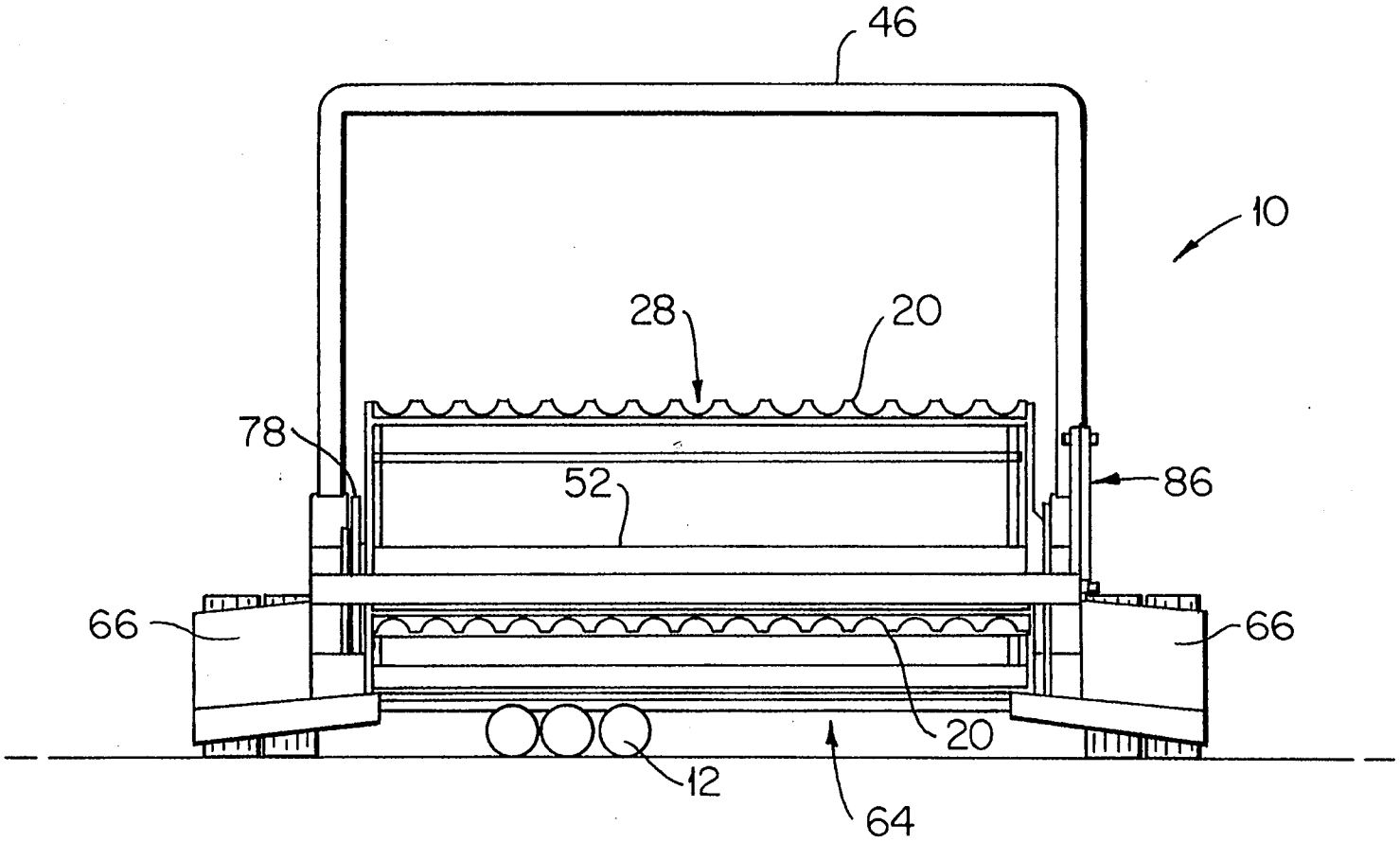
FIG. 3 is a front end view of the apparatus.

Referring to the accompanying drawings with specific reference to FIGS. 1, 2 and 3, it can be seen that apparatus 10 for scooping up articles, typically golf balls 12, from the ground 14 comprises a rotary scoop 16 which can rotate about axis 18 extending parallel to the ground 14. The scoop 16 comprises three elongate elements 20 uniformly spaced in the radial direction about and extending parallel to the axis 18. The elongate elements 20 are connected between coaxial hubs 22 and 24 which are arranged to rotate about axis 18. Each hub is provided with three radially extending spokes 26. Each elongate element 20 is connected at its opposite ends to a spoke 26 of each hub 22 and 24.

The radially distant longitudinal edge of each elongate element 20 is provided with a series of semi-circular cut-outs 28 in which a golf ball can be seated. A stop plate 30 extending in the plane of the spokes 26 is attached at each end of each elongate element 20 to prevent articles thereon from rolling off in a direction parallel to the axis 18.

A guiding means in the form of curved plate 32 is located behind the scoop 16 in the normal direction of travel of the apparatus 10 shown by arrow D. The plate 32 has a lower edge 34 extending parallel to the ground 14 at a height to prevent the passage of a golf ball 12 between the edge 34 and the ground 14. The spokes 26 are of a length so as to radially space the elongate elements 20 from the axis 18 by a distance so that, for a portion of a revolution of the scoop 16, each elongate element can contact a golf ball 12 on the ground 14 and direct or push that golf ball toward lower edge 34.

The plate 32 is configured so as to guide a golf ball 12 scooped from the ground by scoop 16 into a receptacle 38. The receptacle 38 is in the form of a cylinder located between the elongate elements 20 and having its longitudinal axis coincident with the axis of rotation 18. An opening 40 is formed along the length of receptacle 38 near an upper edge 42 of the plate 32. A golf ball 12 scooped by scoop 16 is guided by plate 32 so as to fall by the action of gravity through opening 40 into the receptacle 38.

Figure 4:
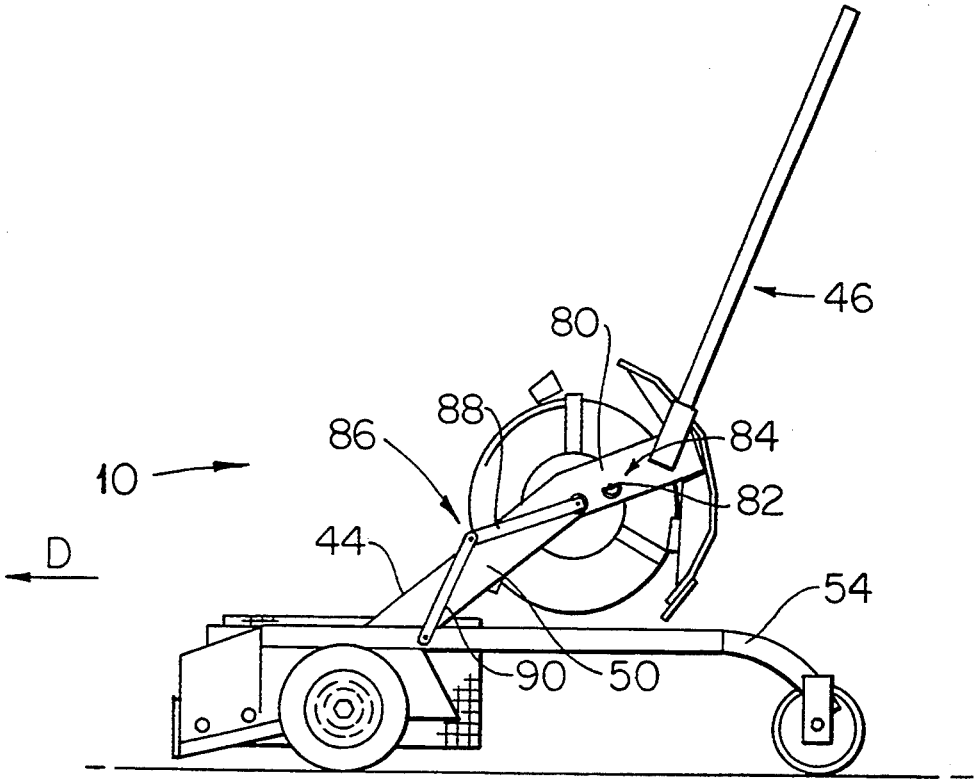
FIG. 4 is a left side view of the apparatus showing a sub-frame of the apparatus pivoted to an intermediate position relative to a main frame of the apparatus.
Figure 5:
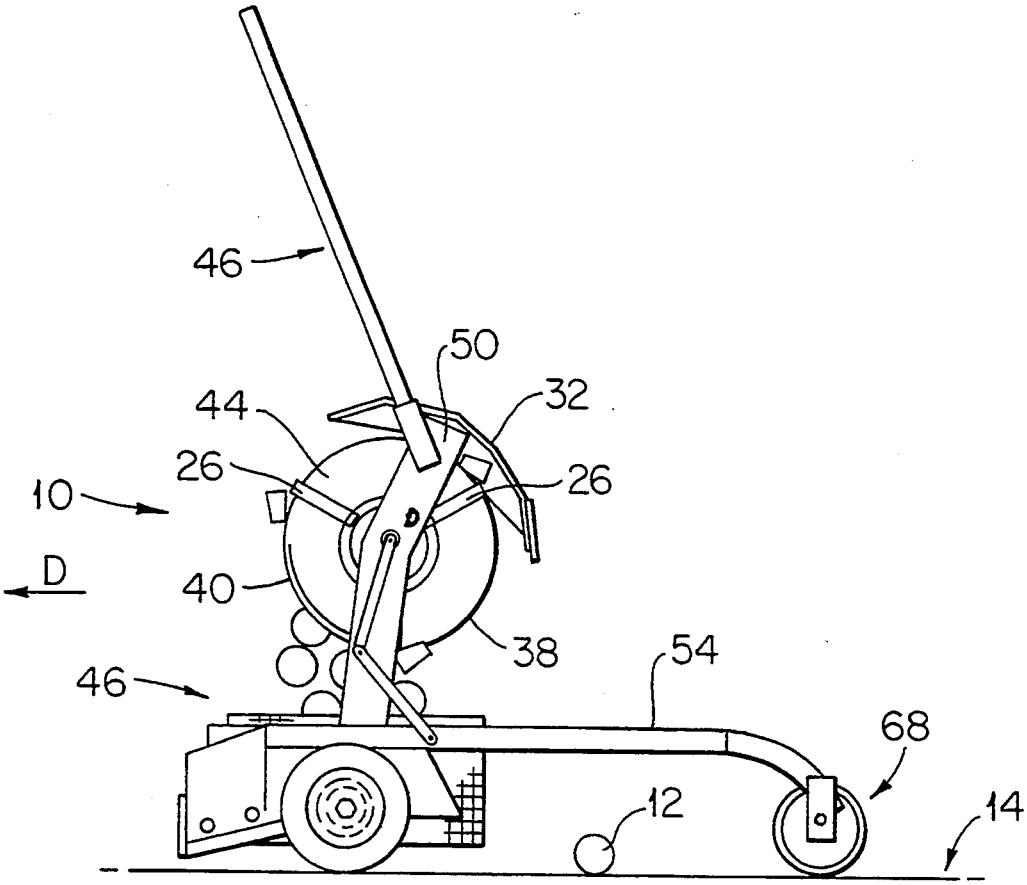
FIG. 5 is a left side view of the apparatus with the sub-frame pivoted to an end position relative to the main frame.

The scoop 16, receptacle 38 and plate 36 are connected to a sub-frame 44 (refer FIGS. 4 & 5). A handle 46 is also connected to the sub-frame 44 and extends upwardly in an inclined plane away from axis 18 in the direction of travel D of the apparatus 10. The sub-frame 44 comprises a pair of spaced apart planar elements 48 and 50. The plate 32 is connected between rear ends of the planar elements 48 and 50. An axle 52 coincident with axis 18 on which said receptacle 38 and scoop 16 are mounted is passes through planar elements 48 and 50 at a location forward of plate 36.

A substantially square-shaped main frame 54 (refer FIG. 3) is provided to support the sub-frame 44 and demountably hold a storage bin in the form of wire basket 56. Two pairs of wheels 58 and 60 are attached to opposite ends of a rotatable axle 62 connected with the main frame 54. Axle 62 extends parallel to axis 18 and is located forward of the scoop 16. The wheels 58 and 60 are disposed outside the confines of the main frame 54. The space between the wheel pairs 58 and 60 below the main frame 54 forms a mouth 64 leading to the scoop 16. A flange 66 is attached to the main frame 54 on each side of the mouth 64 extending forward of the adjacent wheel pairs in a direction of travel so as to guide golf balls 12 lying in the path of the wheels 58, 60 into the mouth 64.

A pair of rollers 68 are rotatably coupled to an axle 70 connected to the main frame 54 in a position rearward of the plate 36 in the direction of travel. A small gap 72 is formed between the rollers 68 to provide a flow path for water or mud lying on the ground 14 in front of the rollers 68. A forward end of each planar element 48 and 50 is pivotally coupled about axle 62 to the main frame 54. As seen from FIGS. 4 and 5, this pivotal connection between the sub-frame 44 and main frame 54 allows the receptacle 38 to be pivoted to a position where golf balls held therein can fall with action of gravity into the basket 56. The basket 56 can then be directly lifted from the main frame 54 and carried to a desired location.

The scoop 16 is caused to rotate by a chain drive mechanism comprising a sprocket (not shown) mounted on axle 62, a sprocket (not shown) co-axially connected to hub 22 and an endless chain 78 meshing with both sprockets. Torque imparted to the sprocket on axle 62 by pushing the apparatus 10 over the ground 12 is transferred to the sprocket on hub 22 by chain 78, causing rotation of the scoop 16.

A height adjustment mechanism 80 (refer FIG. 5) for adjusting the height of the lower edge 34 of plate 36 is connected to planar elements 48 and 50 and bears against main frame 54. Each height adjustment mechanism 80 is in the form of a small tab 82 extending laterally of the planar elements 48, 50 which threadingly receives a bolt 84. One end of the bolt 84 rests on the main frame 54 so that turning the bolt in opposite directions lowers and raises the lower edge 64 relative to the ground 14.

Linkage 86 connects planar element 50 to the main frame 54. The linkage 86 comprises a first link 88 pivotally coupled at one end to the axle 52 and at an opposite end to a second link 90. An opposite arm of link 90 is pivotally coupled to the main frame 54.

The method of use of the apparatus 10 will now be described.

The apparatus 10 is pushed over the ground 14 by a person walking behind the apparatus 10 and holding onto handle 46. As the apparatus 10 is moved over the ground, wheels 58 and 60 rotate causing the scoop 16 to rotate. Golf balls 12 entering mouth 64 will be contacted by one of the elongate elements 20 and directed onto plate 32. The golf balls 12 are prevented from passing under the edge 34. As the scoop 16 continues to rotate, golf balls scooped up by the scoop 16 are directed by the plate 32 to fall by the action of gravity into opening 40 of the receptacle 38. Golf balls lying in the path of wheels 58 and 60 are guided into the mouth 64 by flanges 66. This prevents the wheels 58 and 60 from running over the golf balls, either embedding the golf balls in the ground or forming depressions in the ground. The rollers 68 assist in flattening the ground. It has been found that when used in wet conditions, a small wave is created in front of the rollers 68 which further assists in levelling the ground 12. When the receptacle 38 is full, the golf balls therein can be emptied into basket 56 by pushing on handle 46 to pivot the sub-frame 44 on axle 52 relative to the main frame 54 (refer FIGS. 4 & 5). This causes golf balls held within the receptacle 38 to fall out of opening 40 by the action of gravity into the basket 56. The basket can then be lifted from the main frame 54 and taken to a desired location.

Now that an embodiment of the invention has been described in detail, it will be apparent to those skilled in the relevant arts that numerous modifications and variations may be made without departing from the basic inventive concepts. For example, the scoop 16 is shown as being driven by the action of the wheels 58 and 60 passing over the ground 14. However, in alternate embodiments, the scoop 16 can be driven by an energy conversion apparatus such as an electric motor or petrol motor. In addition, while the apparatus 10 is shown as being a pedestrian apparatus, it may be attached to a lightweight tractor for pulling or pushing across the ground 14. All such modifications and variations are deemed to be within the scope of the present invention, the nature of which is to be determined from the foregoing description and the appended claims.

I claim:

1. An apparatus for collecting articles from the ground, said apparatus including:

a receptacle having an opening for receiving the articles and at least one wall defining a periphery of the receptacle;

rotary scooping means for rotating about said periphery of the receptacle for scooping the articles from the ground;

guiding means, having a lower edge extending substantially parallel to the ground at a height to prevent the passage of the articles between said edge and the ground, for cooperating with said rotary scooping means to guide the articles scooped from the ground by the scooping means to the opening of the receptacle; and drive means for driving the rotary scooping means about the periphery of the receptacle such that when the apparatus is moved over an article on the ground, said article is brought into contact with the lower edge of said guiding means and scooped from the ground by the rotary scooping means, and in cooperation with the guide means, is guided by the guide means to the opening in the receptacle so that the article falls under the influence of gravity through the opening of the receptacle into the receptacle.

2. Apparatus according to claim 1 wherein said rotary scooping means rotates about an axis extending substantially parallel to the ground.

3. An apparatus according to claim 2 wherein said rotary scooping means comprises an elongate element extending parallel to said axis of rotation and radially spaced from said axis by a distance such that for a portion of a revolution of said rotary scooping means, said elongate element can contact an article on the ground and direct said article toward said lower edge.

4. An apparatus according to claim 3 wherein said elongate element is one of a plurality of elongate elements uniformly spaced radially about said axis.

5. An apparatus according to claim 1 wherein said receptacle and said rotary scooping means are supported by a sub-frame which is pivotably connected to a main frame such that said sub-frame can be pivoted between a first position in which said apparatus can scoop an article from the ground and a second position in which said receptacle can be emptied by gravity acting on any article held in said receptacle.

6. An apparatus according to claim 5 further comprising a storage bin supported by said main frame and being located thereon such that when said sub-frame is in said second position, any article held in said receptacle can fall into said storage bin.

7. An apparatus according to claim 1 wherein said apparatus is provided with a least one ground-engaging wheel for allowing said apparatus to be moved over the ground.

8. An apparatus according to claim 7 wherein at least one ground-engaging wheel is rotatably coupled at each side of a mouth of said apparatus, said mouth leading to said rotary scooping means.

9. An apparatus according to claim 8 wherein said apparatus is further provided with a flange at each side of said mouth, each flange extending forwardly of an adjacent ground-engaging wheel for guiding articles lying on the ground in front of said wheels into said mouth.

10. An apparatus according to claim 5 further comprising a ground-engaging roller means, rotatably coupled to the main frame and disposed rearwardly of said guiding means, for smoothing the ground.

11. An apparatus according to claim 10 wherein said roller means comprises at least two spaced apart rollers.

12. an apparataus according to claim 1 wherein said drive means comprises a sprocket and belt arrangement coupled between the scooping means and ground-engaging wheels so that, as said apparatus moves over the ground, the scooping means is driven by the sprocket and belt arrangement.

* * * * *